US008844611B2

(12) United States Patent
Yao et al.

(10) Patent No.: US 8,844,611 B2
(45) Date of Patent: Sep. 30, 2014

(54) PLATE STACKING TYPE HEAT EXCHANGER

(75) Inventors: Tsuyoshi Yao, Yokohama (JP); Tatsuhito Yamada, Yokohama (JP)

(73) Assignee: Tokyo Roki Co., Ltd., Yokohama-shi (JP)

( * ) Notice: Subject to any disclaimer, the term of this patent is extended or adjusted under 35 U.S.C. 154(b) by 835 days.

(21) Appl. No.: 12/738,952

(22) PCT Filed: Jun. 16, 2008

(86) PCT No.: PCT/JP2008/060960

§ 371 (c)(1),
(2), (4) Date: Jun. 7, 2010

(87) PCT Pub. No.: WO2009/054162

PCT Pub. Date: Apr. 30, 2009

(65) Prior Publication Data

US 2010/0258285 A1 Oct. 14, 2010

(30) Foreign Application Priority Data

Oct. 23, 2007 (JP) ..... 2007-275365

(51) Int. Cl.
*F28D 9/00* (2006.01)
*F28F 3/04* (2006.01)

(52) U.S. Cl.
CPC ..... *F28D 9/005* (2013.01); *F28F 3/046* (2013.01); *F28D 9/0037* (2013.01); *F28D 9/0056* (2013.01)
USPC ..... 165/167; 165/78; 165/176

(58) Field of Classification Search
USPC ..... 165/78, 167, 176
See application file for complete search history.

(56) References Cited

U.S. PATENT DOCUMENTS

| | | | | |
|---|---|---|---|---|
| 1,992,097 | A * | 2/1935 | Seligman | 165/167 |
| 5,992,510 | A * | 11/1999 | Kallrot | 165/78 |
| 6,340,053 | B1 * | 1/2002 | Wu et al. | 165/167 |
| 6,843,311 | B2 * | 1/2005 | Evans et al. | 165/167 |
| 7,377,308 | B2 * | 5/2008 | Ware | 165/167 |
| 7,694,728 | B2 | 4/2010 | Nakamura | |

FOREIGN PATENT DOCUMENTS

| | | |
|---|---|---|
| CN | 101048638 A | 10/2007 |
| DE | 60014580 | 10/2005 |
| GB | 1227872 | 6/1972 |
| JP | 55-46963 | 3/1980 |
| JP | 5-79282 | 10/1993 |

(Continued)

*Primary Examiner* — Allen Flanigan
(74) *Attorney, Agent, or Firm* — Harness, Dickey & Pierce, P.L.C.

(57) ABSTRACT

An object of the present invention is to provide a plate stacking type heat exchanger including plates having a small longitudinal dimension. In a plate stacking type heat exchanger 100 according to the present invention, an inlet port for low temperature fluid 59*a* and an outlet port for low temperature fluid 59*b* are provided on one end side in the longitudinal direction of a plate (left side in FIG. 1). A partition part formed of partition members 10*a* and 10*b* is formed in each low temperature fluid compartment 60. The low temperature fluid flows each of the low temperature fluid compartments 60 along a U-turn path that is not short in length.

2 Claims, 5 Drawing Sheets

(56) References Cited

FOREIGN PATENT DOCUMENTS

| | | |
|---|---|---|
| JP | 2004-530092 | 9/2004 |
| JP | 2006-64281 | 3/2006 |
| JP | 2006-125830 | 5/2006 |
| JP | 2006-183969 | 7/2006 |
| JP | 2007-127390 | 5/2007 |
| JP | 2007-198660 | 8/2007 |
| WO | WO-00/40914 | 7/2000 |

* cited by examiner

PLATE STACKING TYPE HEAT EXCHANGER

TECHNICAL FIELD

The present invention relates to a plate stacking type heat exchanger, such as an oil cooler and an EGR cooler.

BACKGROUND ART

A plate stacking type heat exchanger is an apparatus that exchanges heat between a high temperature fluid (oil and EGR gas, for example) and a low temperature fluid (water, for example) via stacked plates. The apparatus includes end plates and a plurality of pairs of core plates stacked therebetween, and peripheral flanges of each of the pairs of core plates are bonded to each other in a brazing process, whereby high temperature fluid compartments through which the high temperature fluid flows and low temperature fluid compartments through which the low temperature fluid flows are defined in the space surrounded by the end plates and the core plates, and the high and low temperature fluid compartments communicate with respective pairs of circulation holes provided in one of the end plates. For example, national Publication of International Patent Application No. 2004-530092 describes a plate stacking type heat exchanger of this type.

In a conventional plate stacking type heat exchanger of this type, each of the core plates is provided by forming a substantially flat plate and has a pair of an inlet port for high temperature fluid and an outlet port for high temperature fluid, which communicate with one of the pairs of circulation holes, on both ends in the width direction of the plate on one end side in the longitudinal direction thereof. Further, protrusions are formed on one side of each of the plates. The protrusions extend from the inlet port for high temperature fluid toward the other end side of the plate in the longitudinal direction thereof, form a U-turn region on the other end side in the longitudinal direction of the plate, and return to the outlet port for high temperature fluid. Further, each of the core plates has a pair of an inlet port for low temperature fluid and an outlet port for low temperature fluid, which communicate with the other pair of circulation holes, on both ends in the longitudinal direction of the plate.

That is, in the conventional plate stacking type heat exchanger, the inlet port for low temperature fluid is provided outside the area where the U-turn region is formed on the other end side in the longitudinal direction of the plate, whereas the outlet port for low temperature fluid is provided outside the area where the pair of the inlet port for high temperature fluid and the outlet port for high temperature fluid are provided on the one end side in the longitudinal direction of the plate. Each of the pairs of core plates is assembled in such a way that the side of one of the two core plates that is opposite the one side on which the protrusions are formed faces the side of the other one of the two core plates that is opposite the one side and the protrusions formed on the respective core plates are paired but oriented in opposite directions to form the corresponding high temperature fluid compartment, and the low temperature fluid compartments are formed between the pairs of core plates and between each of the end plates and the core plate adjacent thereto.

DISCLOSURE OF THE INVENTION

Problems to be Solved by the Invention

The conventional plate stacking type heat exchanger, however, has a structure in which the inlet port for low temperature fluid and the outlet port for low temperature fluid are provided on both ends in the longitudinal direction of each of the plates and hence the two ports are fairly spaced apart from each other in the longitudinal direction of the plate, disadvantageously resulting in an increased longitudinal dimension of the plate.

That is, the conventional plate stacking type heat exchanger is configured in such a way that the low temperature fluid flows substantially in a linear manner in the longitudinal direction of the plate and has a structure in which the inlet port for low temperature fluid is provided outside the area where the U-turn region is formed on the other end side in the longitudinal direction of the plate, whereas the outlet port for low temperature fluid is provided outside the area where the pair of the inlet port for high temperature fluid and the outlet port for high temperature fluid are provided on the one end side in the longitudinal direction of the plate. In the thus configured conventional plate stacking type heat exchanger, it is necessary to provide areas (spaces) for disposing the inlet port for low temperature fluid and the outlet port for low temperature fluid, inevitably resulting in an increased longitudinal dimension of the plate.

The present invention has been made in view of the problem with the related art described above. An object of the present invention is to provide a plate stacking type heat exchanger including plates having a small longitudinal dimension.

Means for Solving the Problems

To solve the problem described above, the present invention provides a plate stacking type heat exchanger comprising end plates; a plurality of pairs of core plates stacked therebetween; and high temperature fluid compartments through which high temperature fluid flows and low temperature fluid compartments through which low temperature fluid flows defined in the space surrounded by the end plates and the core plates by bonding peripheral flanges of each of the pairs of core plates to each other in a brazing process, the high and low temperature fluid compartments communicating with respective pairs of circulation holes provided in one of the end plates. The plate stacking type heat exchanger is characterized by the following features: Each of the core plates is provided by forming a substantially flat plate and has a pair of an inlet port for high temperature fluid and an outlet port for high temperature fluid, which communicate with one of the pairs of circulation holes, on one end side in the longitudinal direction of the plate and a pair of an inlet port for low temperature fluid and an outlet port for low temperature fluid, which communicate with the other pair of circulation holes, on the other end side in the longitudinal direction of the plate. Protrusions are formed on one side of each of the plates, the protrusions extending from the inlet port for high temperature fluid toward the other end side in the longitudinal direction of the plate, forming U-turn regions on the other end side in the longitudinal direction of the plate, and returning to the outlet port for high temperature fluid. Each of the pairs of core plates is assembled to form the corresponding high temperature fluid compartment in such a way that the side of one of the two core plates that is opposite the one side faces the side of the other one of the two core plates that is opposite the one side and the protrusions formed on the respective core plates are paired but oriented in opposite directions. The low temperature fluid compartments are formed between the pairs of core plates and between the end plates and the core plates adjacent thereto. A partition part is formed in each of the low temperature fluid compartments, the partition part partitioning the area where the U-turn regions are formed and the area outside that area into an area including the inlet port for low temperature fluid and an area including the outlet port for low temperature fluid.

In the configuration described above, the inlet port for low temperature fluid and the outlet port for low temperature fluid are provided on the other end side in the longitudinal direction of each of the plates in such a way that the two ports are close to each other in the width direction of the plate. The longitudinal dimension of each of the plates is thus reduced in the plate stacking type heat exchanger of the present invention. Even when the configuration described above is employed, the partition part formed in each of the low temperature fluid compartments prevents the low temperature fluid from flowing in the width direction of the corresponding plates between the inlet port for low temperature fluid and the outlet port for low temperature fluid (shorter path length) but rather allows the low temperature fluid to flow along the U-turn regions on the one end side in the longitudinal direction of the plates (longer path length). The heat transfer area of the plates thus increases, and the heat exchanger functions as expected. Each of the partition parts may or may not be formed in a continuous form, but is preferably formed in a continuous form to prevent a shorter path length and improve the strength of the area of the corresponding plates where the U-turn regions are formed.

The present invention is also characterized by the following features: Each of the partition parts is formed of a partition member sandwiched between the plates that form the corresponding low temperature fluid compartment. The partition member is formed of a column part disposed in an area outside the area where the U-turn regions are formed and an extension part extending from the column part toward the center of the U-turn regions.

The present invention is also characterized by the following features: Each of the partition parts is formed of a columnar member sandwiched between the plates that form the corresponding low temperature fluid compartment and a joint part formed of joint protrusions provided on the plates that form the low temperature fluid compartment. The columnar member is disposed to come into contact with the outer wall of the protrusions that form the U-turn regions in an area outside the area where the U-turn regions are formed in the low temperature fluid compartment. The joint part is configured to come into contact with the columnar member in the area where the U-turn regions are formed in the low temperature fluid compartment and extend from the contact portion toward the center of the U-turn region.

The present invention is also characterized by the following features: Each of the core plates has a bolt through hole formed therein in the area outside the area where the U-turn regions are formed, the bolt through hole passing through in the stacked direction. Each of the end plates and the columnar members has a bolt through hole that communicates with the bolt through holes in the core plates. A bolt is inserted into the bolt through holes to fasten the core plates, the end plates, and the columnar members.

The present invention further provides a plate stacking type heat exchanger comprising end plates; a plurality of pairs of core plates stacked therebetween; and high temperature fluid compartments through which high temperature fluid flows and low temperature fluid compartments through which low temperature fluid flows defined in the space surrounded by the end plates and the core plates by bonding peripheral flanges of each of the pairs of core plates to each other in a brazing process, the high and low temperature fluid compartments communicating with respective pairs of circulation holes provided in one of the end plates. The plate stacking type heat exchanger is characterized by the following features: Each of the core plates is provided by forming a substantially flat plate and has a pair of an inlet port for high temperature fluid and an outlet port for high temperature fluid, which communicate with one of the pairs of circulation holes, on one end side in the longitudinal direction of the plate and a pair of an inlet port for low temperature fluid and an outlet port for low temperature fluid, which communicate with the other pair of circulation holes, on the other end side in the longitudinal direction of the plate. Protrusions are formed on one side of each of the plates, the protrusions extending from the inlet port for high temperature fluid toward the other end side in the longitudinal direction of the plate, forming U-turn regions on the other end side in the longitudinal direction of the plate, and returning to the outlet port for high temperature fluid. Each of the pairs of core plates is assembled to form the corresponding high temperature fluid compartment in such a way that the side of one of the two core plates that is opposite the one side faces the side of the other one of the two core plates that is opposite the one side and the protrusions formed on the respective core plates are paired but oriented in opposite directions. The low temperature fluid compartments are formed between the pairs of core plates and between the end plates and the core plates adjacent thereto. A partition part is formed in each of the low temperature fluid compartments, the partition part partitioning along the longitudinal direction of the corresponding plates the interior of the low temperature fluid compartment into an area including the inlet port for low temperature fluid and an area including the outlet port for low temperature fluid so as to form an inverse U-shaped flow path, the shape of which is an inverse shape of the U-turn regions.

The present invention is also characterized by the following features: Each of the partition parts is formed of a columnar member sandwiched between the plates that form the corresponding low temperature fluid compartment and a joint part formed of joint protrusions provided on the plates that form the low temperature fluid compartment. The columnar member is disposed to come into contact with the outer wall of the protrusions that form the U-turn regions in an area outside the area where the U-turn regions are formed in the low temperature fluid compartment. The joint part is configured to come into contact with the columnar member in the area where the U-turn regions are formed in the low temperature fluid compartment, extend from the contact portion toward the center of the U-turn regions, and further extend from the center to one end side in the longitudinal direction of the plates.

The present invention is also characterized in that among the joint protrusions provided on the plates, part of each of the joint protrusions provided on the core plates, the portion extending from the center to the one end side in the longitudinal direction, is formed of one of the protrusions that form the corresponding U-turn regions.

RELATED DOCUMENTS AND CROSS REFERENCE

The present application claims the priority of Japanese Patent Application No 2007-275365 filed on Oct. 23, 2006, and the disclosure thereof are hereby incorporated.

DESCRIPTION OF SYMBOLS

Figure 1:
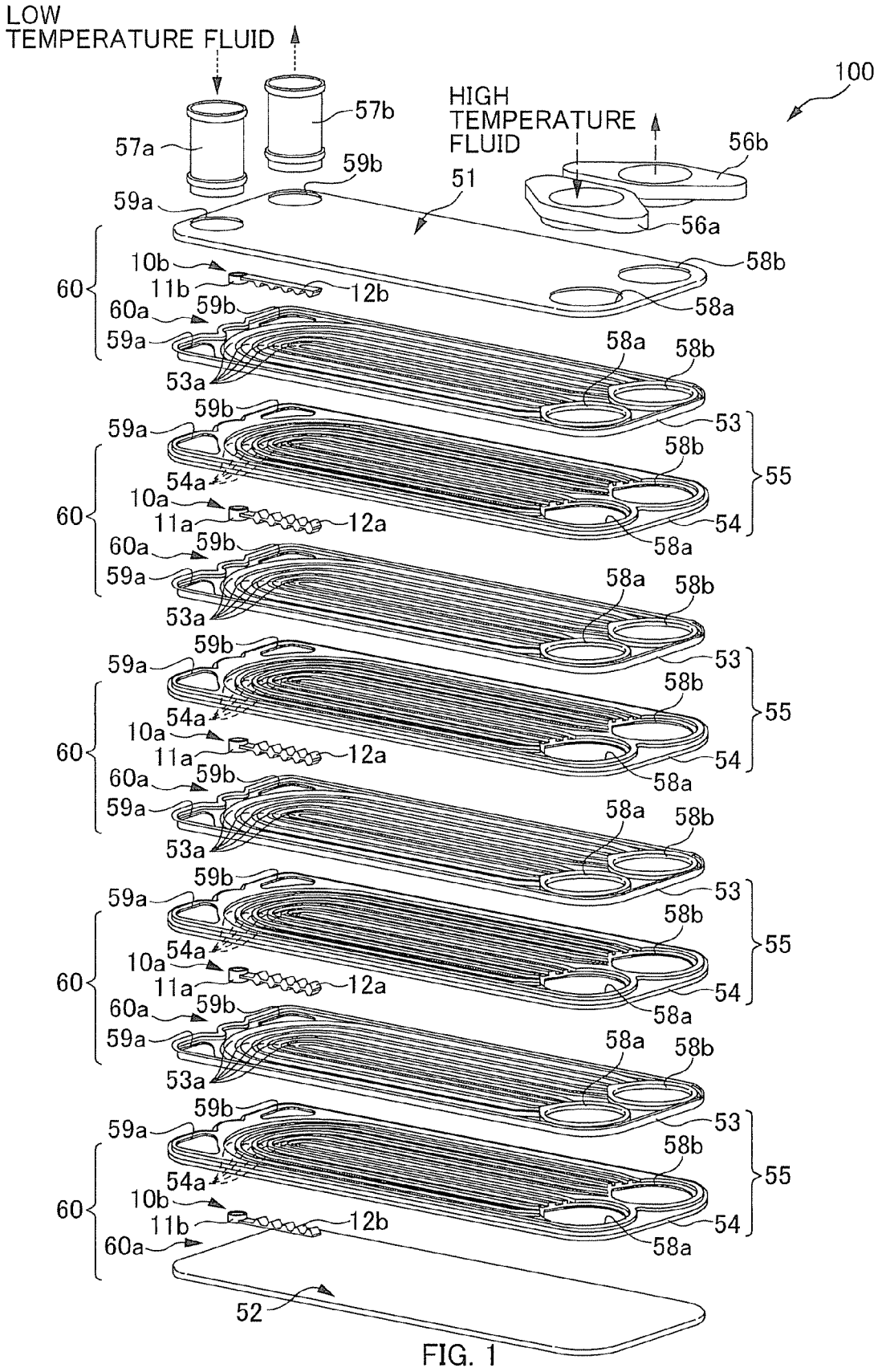
FIG. 1 is an exploded perspective view showing a plate stacking type heat exchanger according to a first embodiment of the present invention.

10*a*, 10*b* partition member
11*a*, 11*b* column part
12*a*, 12*b* extension part
20 columnar member
51, 52 end plate
53, 54 core plate
53*a*, 54*a* (U-shaped) protrusion
51*a*, 52*a*, 53*b*, 54*b* joint protrusion
55 high temperature fluid compartment (a pair of core plates)
60 low temperature fluid compartment
60*a* area outside area where U-turn regions are formed
100, 200, 300 plate stacking type heat exchanger
510*a*, 520*a*, 530*b*, 540*b* joint protrusion

BEST MODE FOR CARRYING OUT THE INVENTION

Embodiments of the present invention will be described below.

First Embodiment

A plate stacking type heat exchanger according to a first embodiment of the present invention will first be described with reference to FIG. 1. FIG. 1 is an exploded perspective view showing the plate stacking type heat exchanger according to the first embodiment of the present invention.

A plate stacking type heat exchanger 100 shown in FIG. 1 includes end plates 51 and 52 and a plurality of pairs of core plates 53 and 54 stacked therebetween, and peripheral flanges of each of the pairs of core plates 53 and 54 are bonded to each other in a brazing process, whereby high temperature fluid compartments 55 through which high temperature fluid flows and low temperature fluid compartments 60 through which low temperature fluid flows are defined in the space surrounded by the end plates 51, 52 and the core plates 53, 54, and the high and low temperature fluid compartments communicate with respective pairs of circulation pipes 56*a*, 56*b* and 57*a*, 57*b* provided in the end plate 51 or 52 (the end plate 51 in FIG. 1) and jutting therefrom.

Each of the core plates 53 and 54 is provided by forming a substantially flat plate and has a pair of an inlet port for high temperature fluid 58*a* and an outlet port for high temperature fluid 58*b*, which communicate with the pair of circulation pipes 56*a* and 56*b*, on one end side in the longitudinal direction of the plate (right side in FIG. 1) and a pair of an inlet port for low temperature fluid 59*a* and an outlet port for low temperature fluid 59*b*, which communicate with the other pair of circulation pipes 57*a* and 57*b*, on the other end side in the longitudinal direction of the plate (left side in FIG. 1). A plurality of protrusions 53*a* and 54*a* are formed on one side of the plates, that is, on the upper side of the core plates 53 and the lower side of the core plates 54, respectively. Each of the protrusions 53*a* and 54*a* extends from the inlet port for high temperature fluid 58*a* toward the other end side in the longitudinal direction of the corresponding plate, forms a U-turn region on the other end side in the longitudinal direction of the plate, and returns to the outlet port for high temperature fluid 58*b*.

Each of the pairs of core plates 53 and 54 is assembled to form the corresponding high temperature fluid compartment 55 in such a way that the side of one of the two core plates 53 and 54 that is opposite the one side faces the side of the other one of the two core plates that is opposite the one side and the protrusions 53*a* and 54*a* formed on the respective core plates are paired but oriented in opposite directions. The low temperature fluid compartments 60 are formed between the pairs of core plates 53 and 54 and between the end plates 51, 52 and the core plates 53, 54 adjacent thereto.

In each of the low temperature fluid compartments 60, a partition part is formed. The partition part partitions the area where the U-turn regions are formed and the area outside that area (see an area 60*a* in FIG. 1) into an area including the inlet port for low temperature fluid 59*a* and an area including the outlet port 59*b* for low temperature fluid. More specifically, in the plate stacking type heat exchanger 100 shown in FIG. 1, the partition part is formed of partition members 10*a* and 10*b* separate from the plates 51 to 54. The partition members 10*a* are sandwiched between the respective core plate 53 and core plate 54, and the partition members 10*b* are sandwiched between the end plate 51 and the core plate 53 adjacent thereto and between the end plate 52 and the core plate 54 adjacent thereto. The partition members 10*a* and 10*b* respectively include column parts 11*a* and 11*b* disposed in the area 60*a* outside the area where the U-turn regions are formed and extension parts 12*a* and 12*b* extending from the column parts 11*a* and 11*b* toward the center of the U-turn regions. The extension parts 12*a* and 12*b* have protrusions and recesses provided thereon, and the protrusions fit into the gaps between the plurality of protrusions (that is, the recesses between adjacent protrusions 53*a* and 53*a* and the recesses between adjacent protrusions 54*a* and 54*a*) formed on the core plates 53 and 54.

In the configuration described above, the inlet port for low temperature fluid 59*a* and the outlet port for low temperature fluid 59*b* are provided on the other end side in the longitudinal direction of each of the plates in such a way that the two ports are close to each other in the width direction of the plate. The longitudinal dimension of each of the plates is thus reduced in the plate stacking type heat exchanger 100. Even when the configuration described above is employed, the partition member 10*a* or 10*b* formed in each of the low temperature fluid compartments 60 prevents the low temperature fluid from flowing in the width direction of the corresponding plates between the inlet port for low temperature fluid 59*a* and the outlet port for low temperature fluid 59*b* (shorter path length) but rather allows the low temperature fluid to flow along the U-turn regions on the one end side in the longitudinal direction of the plates (longer path length). The heat transfer area of the plates thus increases, and the heat exchanger functions as expected.

Second Embodiment

Figure 2:
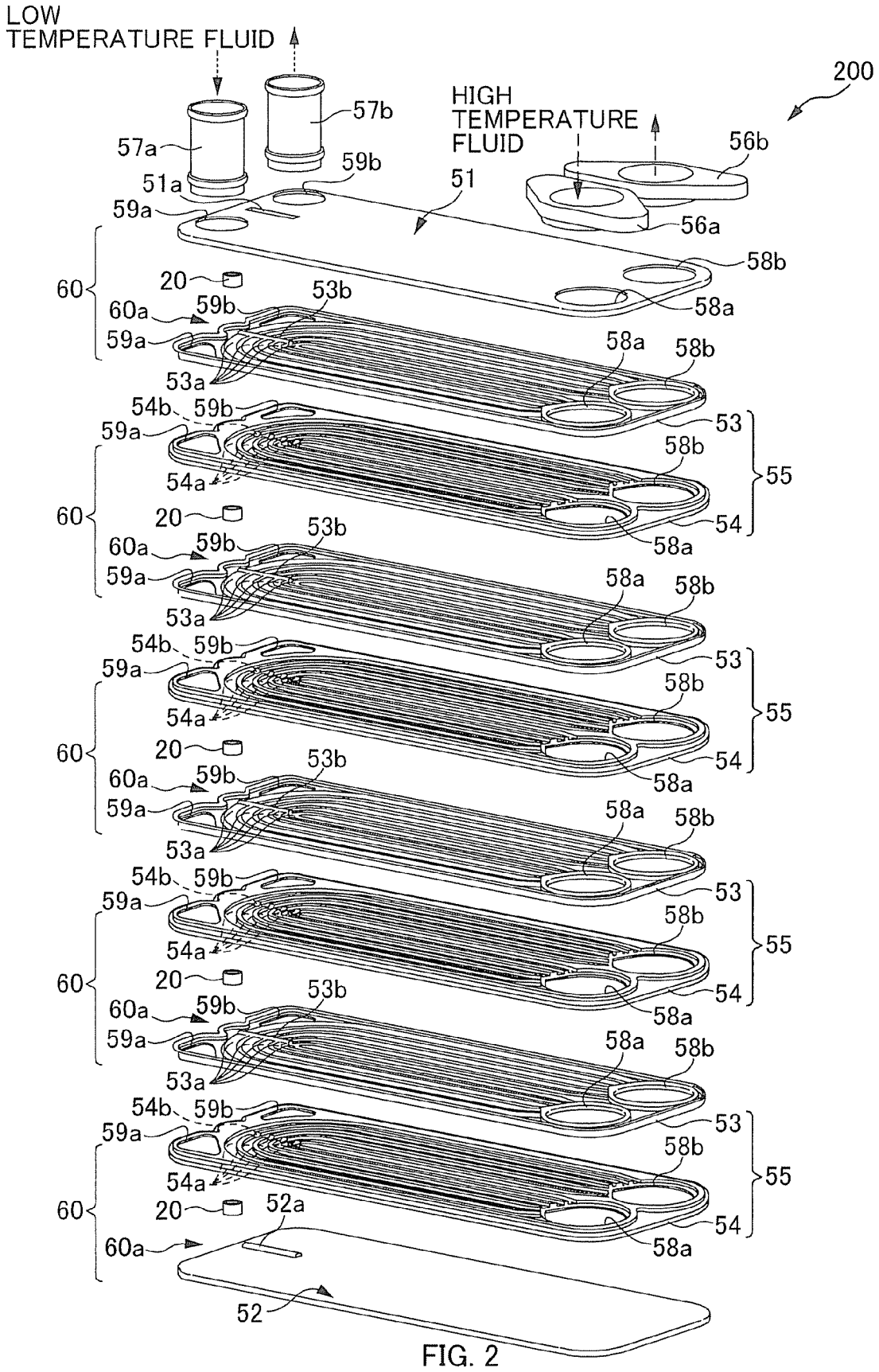
FIG. 2 is an exploded perspective view showing a plate stacking type heat exchanger according to a second embodiment of the present invention.

A plate stacking type heat exchanger according to a second embodiment of the present invention will be described with reference to FIG. 2. In FIG. 2, the portions that are the same as those shown in FIG. 1 have the same reference characters, and the portions (partition parts) different from those shown in FIG. 1 will be primarily described. FIG. 2 is an exploded perspective view showing the plate stacking type heat exchanger according to the second embodiment of the present invention.

In a plate stacking type heat exchanger 200 shown in FIG. 2, partition parts are formed of columnar members 20 (collars, for example) sandwiched between the plates that form the low temperature fluid compartments 60 and joint parts formed of joint protrusions provided on the plates, that is, a joint part formed of a joint protrusion 51*a* and a joint protrusion 53*b*, a joint part formed of a joint protrusion 52*a* and a joint protrusion 54*b*, and joint parts formed of joint protrusions 53*b* and joint protrusions 54*b*.

Each of the columnar members 20 is formed of a member separate from the corresponding plates and disposed to come into contact with the outer wall of the outermost one of the protrusions 51*a* to 54*a*, which form the U-turn regions, in the area 60*a* outside the area where the U-turn regions are formed in the corresponding low temperature fluid compartment 60. On the other hand, each of the joint parts is part of the corresponding plate, and not only comes into contact with the corresponding columnar member 20 in the area where the U-turn regions are formed in the corresponding low temperature fluid compartment 60, but also extends from the contact portion toward the center of the U-turn regions. Since this configuration (specifically, the arrangement of the inlet port for low temperature fluid 59*a* and the output port for low temperature fluid 59*b* and the configuration of the partition parts) is the same as that of the plate stacking type heat exchanger 100 described above, the same advantageous effect is naturally provided.

The description of the above embodiments is presented to make the understanding of the present invention easier and is not intended to limit the present invention. Changes and improvements can be made without departing from the spirit of the present invention, which of course, encompasses equivalents thereof.

For example, in the embodiments described above, each of the partition parts is formed of the partition members 10*a* and 10*b* (see FIG. 1) or the columnar members 20 (see FIG. 20), which are separate from the plates 51 to 54. Such separate members are not necessarily used in the present invention, but the present invention also encompasses an embodiment in which the partition parts may be formed only by joining the joint protrusions formed on the plates 51 to 54.

Further, in the embodiments described above, no bolt through hole is formed in the plates 51 to 54. The plates 51 to 54 may have bolt through holes formed therein that communicate with through holes formed in the column parts 11*a*, 11*b* (see FIG. 1) or the columnar members 20 (see FIG. 2), and bolts are inserted into the through holes to fasten the plates 51 to 54 to the column parts 11*a*, 11*b* or the columnar members 20. In this configuration as well, the partition parts are formed as in the plate stacking type heat exchangers 100 and 200 described above, whereby the same advantageous effect is naturally provided. Further, in this configuration, since the plates 51 to 54 are fastened to the column parts 11*a*, 11*b* or the columnar members 20 with the bolts and hence reinforced, the durability of the plate stacking type heat exchanger is improved.

Third Embodiment

Figure 3:
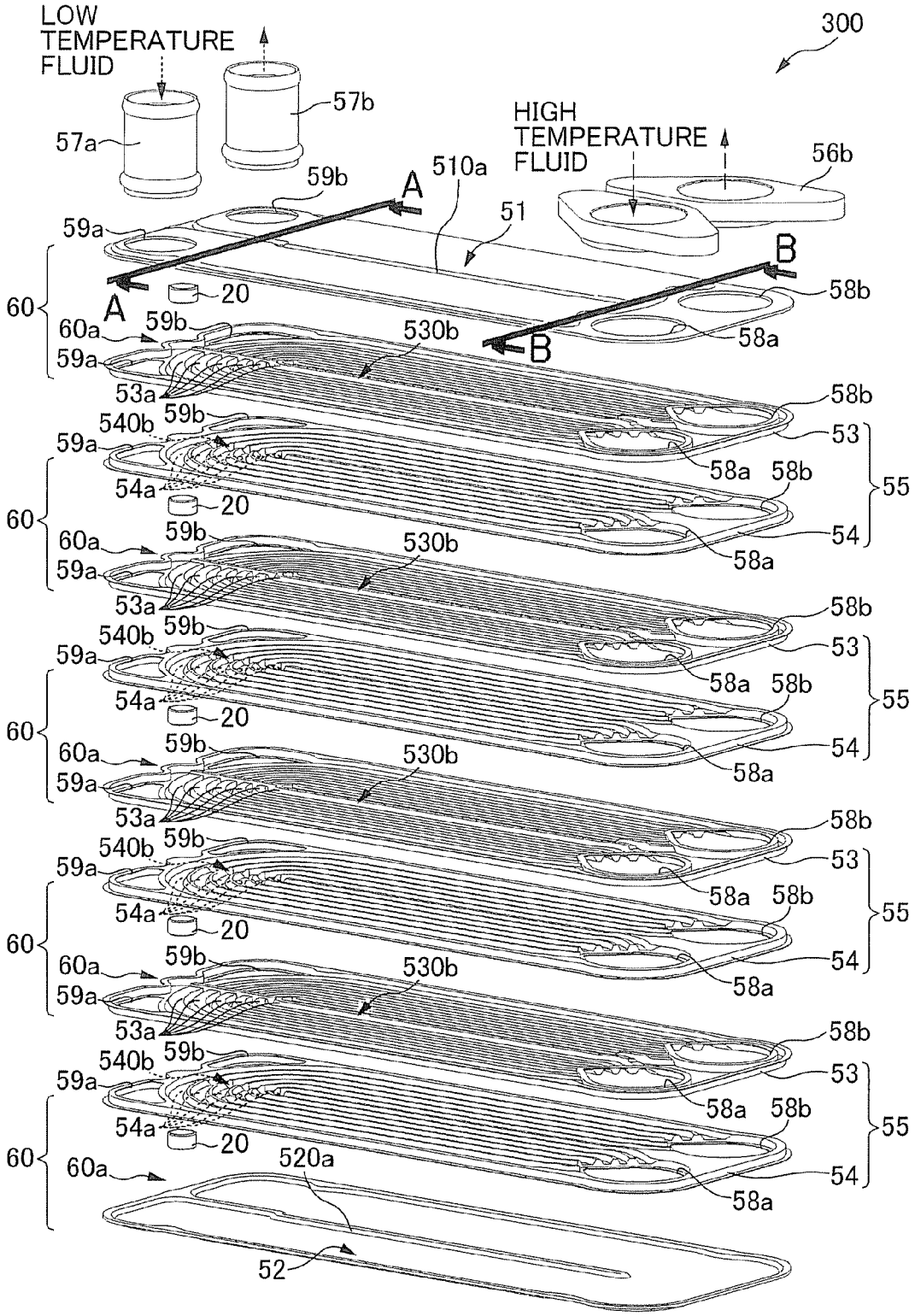
FIG. 3 is an exploded perspective view showing a plate stacking type heat exchanger according to a third embodiment of the present invention.
Figure 4:
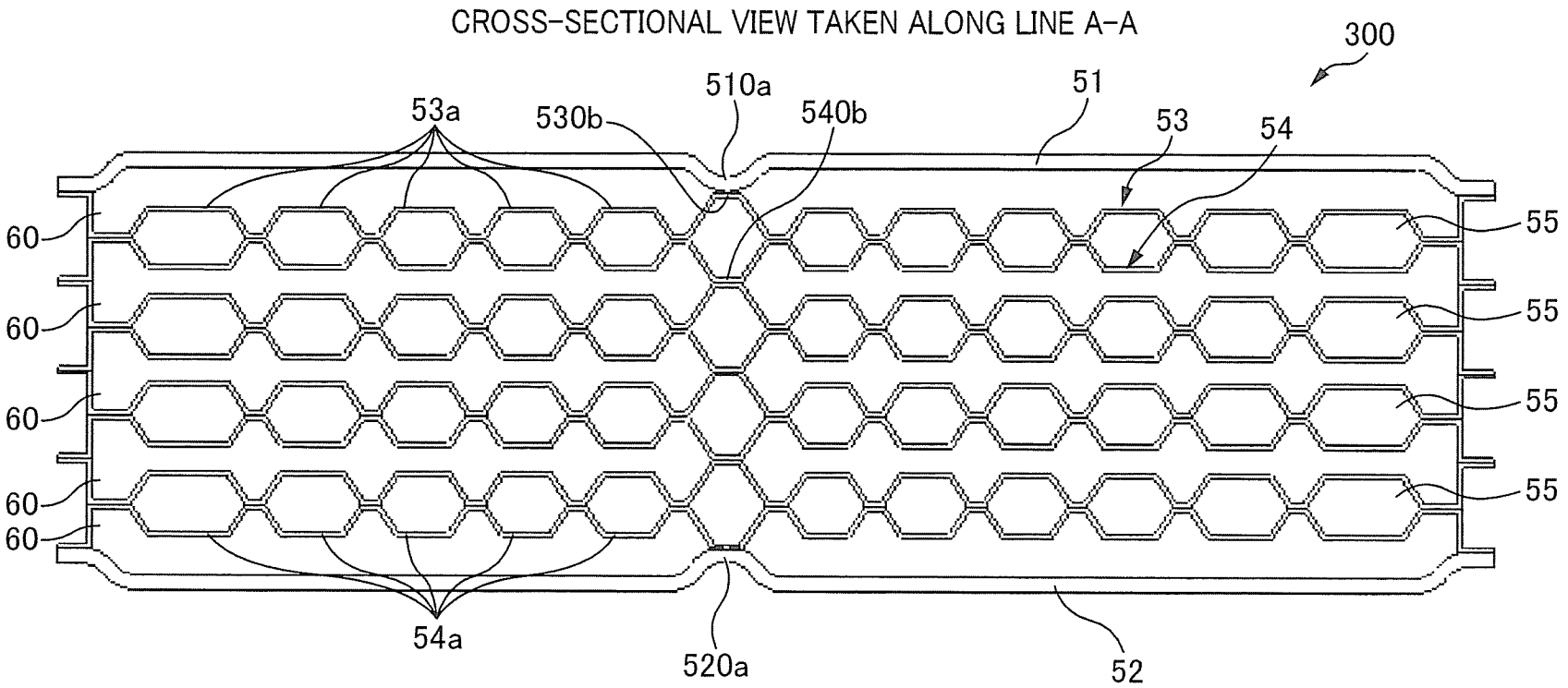
FIG. 4 is a cross-sectional view taken along the line A-A shown in FIG. 3.
Figure 5:
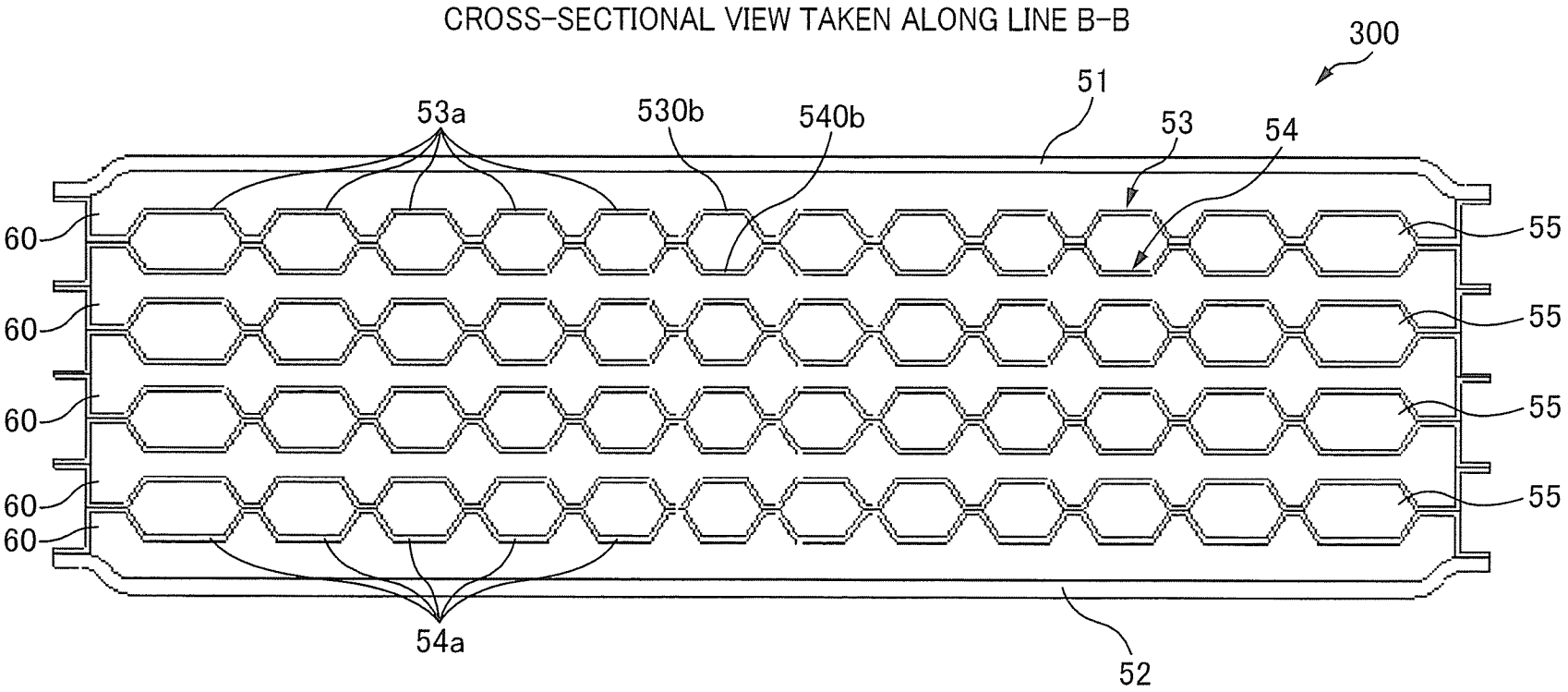
FIG. 5 is a cross-sectional view taken along the line B-B shown in FIG. 3.

Finally, a plate stacking type heat exchanger according to a third embodiment of the present invention will be described with reference to FIGS. 3 to 5. In FIGS. 3 to 5, the portions that are the same as those shown in FIG. 2 have the same reference characters, and the portions (partition parts) different from those shown in FIG. 2 will be primarily described. FIG. 3 is an exploded perspective view showing the plate stacking type heat exchanger according to the third embodiment of the present invention. FIG. 4 is a cross-sectional view taken along the line A-A shown in FIG. 3. FIG. 5 is a cross-sectional view taken along the line B-B shown in FIG. 3.

In a plate stacking type heat exchanger 300 shown in FIGS. 3 to 5, a partition part is formed in each of the low temperature fluid compartments 60. The partition part partitions along the longitudinal direction of the corresponding plates the interior of the low temperature fluid compartment 60 into an area including the inlet port for low temperature fluid 59*a* and an area including the outlet port for low temperature fluid 59*b* so as to form an inverse U-shaped flow path, the shape of which is an inverse shape of the U-turn regions described above.

The partition parts are formed of columnar members 20 and joint parts formed of joint protrusions provided on the plates that form the low temperature fluid compartments 60 (specifically, joints parts formed of joint protrusions 530*b* on the core plates 53 and joint protrusions 540*b* on the core plates 54, a joint part formed of a joint protrusion 510*a* on the end plate 51 and the joint protrusion 530*b* on the uppermost one of the core plates 53, and a joint part formed of a joint protrusion 520*a* on the end plate 52 and the joint protrusion 540*b* on the lowermost one of the core plates 54).

Each of the joint parts comes into contact with the corresponding columnar member 20 in the area where the U-turn regions are formed in the corresponding low temperature fluid compartment 60, extends from the contact portion toward the center of the U-turn regions, and further extends from the center to one end side in the longitudinal direction of the corresponding plates (right side in FIG. 3, and the same applies to FIGS. 4 and 5). Part of each of the joint protrusions 530*b* and 540*b*, the portion extending from the center to the one end side in the longitudinal direction, is formed of the innermost one of the plurality of corresponding protrusions 53*a* and 54*a*, which form the U-turn regions. As shown in FIG. 4, the height of joint protrusion 530*b* is greater than the height of protrusions 53*a* forming the U-turn regions.

In the configuration described above as well, since the plate stacking type heat exchanger 300 has the same configuration as those of the plate stacking type heat exchangers 100 and 200, the same advantageous effect is naturally provided. Further, in the configuration described above, each of the partition parts forms the inverse U-shaped flow path in the corresponding low temperature fluid compartment 60, resulting in an increased area where the low temperature fluid and the high temperature fluid exchange heat. As a result, the heat exchange rate of the plate stacking type heat exchanger 300 is significantly higher than those of the plate stacking type heat exchangers 100 and 200, which means that the plate stacking type heat exchanger 300 is smaller than the plate stacking type heat exchangers 100 and 200, specifically, the longitudinal dimension of the plates is smaller, provided that the heat exchange rates of the plate stacking type heat exchangers 100, 200, and 300 are the same.

INDUSTRIAL APPLICABILITY

The present invention can provide a plate stacking type heat exchanger having high heat exchange rate.

The invention claimed is:

1. A plate stacking type heat exchanger comprising: end plates;

a plurality of pairs of core plates stacked therebetween; and high temperature fluid compartments through which high temperature fluid flows and low temperature fluid compartments through which low temperature fluid flows defined in the space surrounded by the end plates and the core plates by bonding peripheral flanges of each of the pairs of core plates to each other in a brazing process, the high and low temperature fluid compartments communicating with respective pairs of circulation holes provided in one of the end plates, the plate stacking type heat exchanger characterized in that each of the core plates is provided by forming a substantially flat plate and has a pair of an inlet port for high temperature fluid and an outlet port for high temperature fluid, which communicate with one of the pairs of circulation holes, on one end side in the longitudinal direction of the plate and a pair of an inlet port for low temperature fluid and an outlet port for low temperature fluid, which communicate with the other pair of circulation holes, on the other end side in the longitudinal direction of the plate, protrusions are formed on one side of each of the plates, the protrusions extending from the inlet port for high temperature fluid toward the other end side in the longitudinal direction of the plate, forming U-turn regions on the other end side in the longitudinal direction of the plate, and returning to the outlet port for high temperature fluid, each of the pairs of core plates is assembled to form the corresponding high temperature fluid compartment in such a way that the side of one of the two core plates that is opposite the one side faces the side of the other one of the two core plates that is opposite the one side and the protrusions formed on the respective core plates are paired but oriented in opposite directions, the low temperature fluid compartments are formed between the pairs of core plates and between the end plates and the core plates adjacent thereto, and a partition part is formed in each of the low temperature fluid compartments, the partition part partitioning along the longitudinal direction of the corresponding plates the interior of the low temperature fluid compartment into an area including the inlet port for low temperature fluid and an area including the outlet port for low temperature fluid so as to form an inverse U-shaped flow path, the shape of which is an inverse shape of the U-turn regions, each of the partition parts is formed of a columnar member sandwiched between the plates that form the corresponding low temperature fluid compartment and a joint part formed of joint protrusions provided on the plates that form the low temperature fluid compartment, the columnar member is disposed to come into contact with the outer wall of the protrusions that form the U-turn regions in an area outside the area where the U-turn regions are formed in the low temperature fluid compartment, a height of the joint protrusion is more than that of the protrusions forming the U-turn, and the joint part is configured to come into contact with the columnar member in the area where the U-turn regions are formed in the low temperature fluid compartment, extend from the contact portion toward the center of the U-turn regions, and further extend from the center to one end side in the longitudinal direction of the plates.

2. The plate stacking type heat exchanger according to claim 1, characterized in that among the joint protrusions provided on the plates, part of each of the joint protrusions provided on the core plates, the portion extending from the center to the one end side in the longitudinal direction, is formed of one of the protrusions that form the corresponding U-turn regions.

* * * * *